US012037167B2

(12) United States Patent
Barbieri et al.

(10) Patent No.: US 12,037,167 B2
(45) Date of Patent: Jul. 16, 2024

(54) SHEET PACKAGING MATERIAL FOR PRODUCING A SEALED PACKAGE CONTAINING A POURABLE FOOD PRODUCT AND A SEALED PACKAGE OBTAINED FROM A SHEET PACKAGING MATERIAL

(71) Applicant: Tetra Laval Holdings & Finance S.A., Pully (CH)

(72) Inventors: Marcello Barbieri, Modena (IT); Carlo Forcellini, Modena (IT); Giulio Ferrari, Solignano Nuovo (IT); Patricia Civa, Vigatto (IT); Cristina Sirignano, Modena (IT); Alberto Mameli, Modena (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 814 days.

(21) Appl. No.: 17/048,959

(22) PCT Filed: Apr. 15, 2019

(86) PCT No.: PCT/EP2019/059682
§ 371 (c)(1),
(2) Date: Oct. 19, 2020

(87) PCT Pub. No.: WO2019/201862
PCT Pub. Date: Oct. 24, 2019

(65) Prior Publication Data

US 2021/0237926 A1 Aug. 5, 2021

(30) Foreign Application Priority Data

Apr. 20, 2018 (EP) ..... 18168375

(51) Int. Cl.
*B65D 5/06* (2006.01)
*B65D 5/02* (2006.01)
(Continued)

(52) U.S. Cl.
CPC ..... *B65D 5/064* (2013.01); *B65D 5/02* (2013.01); *B65D 5/0209* (2013.01); *B65D 5/42* (2013.01); *B65D 5/4266* (2013.01); *B65D 5/746* (2013.01)

(58) Field of Classification Search
CPC ..... B65D 5/064; B65D 5/02; B65D 5/0209; B65D 5/42; B65D 5/4266; B65D 5/746;
(Continued)

(56) References Cited

U.S. PATENT DOCUMENTS 3,633,814 A 1/1972 Michetti et al.
4,730,766 A 3/1988 Fear
(Continued)

FOREIGN PATENT DOCUMENTS

CN 205470247 U 8/2016
CN 106275688 A 1/2017
(Continued)

OTHER PUBLICATIONS

International Search Report, from PCT/EP2019/059682, mailed Jun. 6, 2019.
Written Opinion, from PCT/EP2019/059682, mailed Jun. 6, 2019.

*Primary Examiner* — Christopher R Demeree
(74) *Attorney, Agent, or Firm* — Knobbe, Martens, Olson & Bear, LLP

(57) ABSTRACT

A sheet packaging material for producing a sealed package with a pourable food product; the packaging material has a quadrangular configuration with two boundary edges parallel to a longitudinal direction and two other boundary edges parallel to a transversal direction orthogonal to the longitu-
(Continued)

dinal direction; the packaging material comprises two transversal crease lines extending transversally to the longitudinal direction and dividing the packaging material into: a bottom region containing a bottom crease pattern and configured to form a bottom portion of the package; a top region containing a top crease pattern and configured to form a top portion of the package; and an intermediate region contained between the transversal crease lines and designed to form a main portion of the package having a plurality of side wall portions; the intermediate region further comprises a plurality of V-shaped crease lines having respective vertices located on or adjacent to the transversal crease lines and at given points thereof destined to define the opposite ends of respective lateral edges delimiting the side wall portions of the package; each V-shaped crease line extending in proximity of the respective transversal crease lines.

14 Claims, 5 Drawing Sheets

(51) Int. Cl.
*B65D 5/42* (2006.01)
*B65D 5/74* (2006.01)

(58) Field of Classification Search
CPC ..... B65D 5/029; B65D 5/3614; B65D 3/08; B65D 5/06; B65D 5/067; B65D 5/563; B65D 5/40; B32B 2439/70; B32B 15/085; B31F 1/08; B65B 3/025; B65B 9/10
USPC ..... 229/165, 106, 213, 164, 5.81, 911; 493/129, 162, 165, 184
See application file for complete search history.

(56) References Cited

U.S. PATENT DOCUMENTS

| | | | | |
|---|---|---|---|---|
| 5,358,175 | A | 10/1994 | Cai | |
| 11,299,314 | B2 * | 4/2022 | Dammers | B65D 5/4266 |
| D968,954 | S * | 11/2022 | Gaudiomonte | D9/433 |
| 2012/0279182 | A1 * | 11/2012 | Barbieri | B65B 3/025 229/164 |
| 2015/0021381 | A1 | 1/2015 | Dolby et al. | |
| 2021/0284379 | A1 * | 9/2021 | Ronchetti | B65B 9/10 |

FOREIGN PATENT DOCUMENTS

| | | | |
|---|---|---|---|
| CN | 107264911 | A | 10/2017 |
| CN | 107264912 | A | 10/2017 |
| CN | 107264914 | A | 10/2017 |
| CN | 208233750 | U | 12/2018 |
| CN | 210793949 | U | 6/2020 |
| DE | 10 2016 003 826 | A1 | 10/2017 |
| EP | 0144736 | A2 | 6/1985 |
| EP | 1 316 508 | A1 | 6/2003 |
| GB | 1243812 | A | 8/1971 |
| JP | H0891348 | A * | 4/1996 |
| JP | H0891348 | A | 4/1996 |
| WO | WO 2017/157676 | A1 | 9/2017 |

* cited by examiner

SHEET PACKAGING MATERIAL FOR PRODUCING A SEALED PACKAGE CONTAINING A POURABLE FOOD PRODUCT AND A SEALED PACKAGE OBTAINED FROM A SHEET PACKAGING MATERIAL

The present invention relates to a sheet packaging material for producing a sealed package containing a pourable food product.

The present invention also relates to a sealed package obtained from a sheet packaging material.

As commonly known, many pourable food products, such as fruit juice, UHT (ultra-high-temperature treated) milk, wine, tomato sauce, etc., are sold in packages made of sterilized packaging material.

A typical example is the parallelepiped-shaped package for liquid or pourable food products known as Tetra Brik Aseptic (registered trademark), which is made by folding, sealing and cutting a web of laminated packaging material. In particular, the packaging material has a multilayer structure comprising a base layer, e.g. of paper, covered on both sides with layers of heat-seal plastic material, e.g. polyethylene. In the case of aseptic packages for long-storage products, such as UHT milk, the packaging material also comprises a layer of oxygen-barrier material, e.g. an aluminium foil, which is superimposed on a layer of heat-seal plastic material, and is in turn covered with another layer of heat-seal plastic material forming the inner face of the package eventually contacting the food product.

Packages of this sort are normally produced on fully automatic packaging machines, on which a continuous tube is formed from the web-fed packaging material; the web of packaging material is sterilized on the packaging machine, e.g. by applying a chemical sterilizing agent, such as a hydrogen peroxide solution, which, once sterilization is completed, is removed from the surfaces of the packaging material, e.g. evaporated by heating; the web so sterilized is then maintained in a closed, sterile environment, and is folded and sealed longitudinally to form a tube, which is fed vertically.

In order to complete the forming operations, the tube is filled with the sterilized or sterile-processed food product, and is sealed and subsequently cut along equally spaced cross sections; pillow packs are so obtained, which are then folded mechanically to form respective finished packages at a final folder.

To allow folding of the web packaging material both during forming and final folding, crease lines, i.e. weakening lines, are formed on the packaging material at the production plant by creasing tools. In practice, the crease lines define folding lines along which the pillow packs are folded to take the desired final configuration.

Alternatively, the packaging material may be cut into blanks, which are formed into packages on forming spindles, and the resulting packages are then filled with the food product and sealed. One example of this type of package is the so-called "gable-top" package known by the trade name Tetra Rex (registered trademark).

To open the above-described packages, these are normally provided with a removable portion, which is partly detached by an opening device from the rest of the packaging material to free a pour opening through which to pour out the product.

The removable portion is formed on the packaging material prior to folding and sealing the packaging material to form the finished package.

The removable portion normally comprises a so-called "prelaminated" hole, i.e. a circular hole formed through the base layer only of the packaging material and covered, when the material is laminated, with the layers of heat-seal plastic material and barrier material, which adhere to one another at the hole.

Each package of the above type, either cut from a tube of packaging material or formed on a forming spindle, is obtained from a basic unit of packaging material having given crease lines.

In other words, the above-mentioned basic unit represents the exact length of the packaging material used to produce one single package.

In the case of packages made from a tube of packaging material, the original web includes a plurality of basic units joined to each other; in the case of packages made on forming spindles, the basic unit is defined by the blank cut from the web prior to starting the forming and sealing operations.

The basic unit typically has a rectangular or square configuration with two boundary edges parallel to a longitudinal direction and two other boundary edges parallel to a transversal direction orthogonal to the longitudinal direction.

Once the basic unit is folded and sealed to form the respective finished package, the longitudinal direction becomes the direction along which the total height of the package itself is defined; the longitudinal direction also represents the main direction of extension of the web from which the basic unit is obtained.

The basic unit usually includes at least two transversal crease lines extending transversally to the longitudinal direction and dividing the basic unit itself into:

- a bottom region containing a bottom crease pattern and configured to form a bottom portion of the finished package;
- a top region containing a top crease pattern and configured to form top portion of the finished package; and
- an intermediate region contained between the transversal crease lines, interposed between the bottom region and top region and usually having a plurality of longitudinal crease lines designed to form lateral edges of a plurality of side walls of the finished package.

The transversal crease lines are also configured to define a bottom peripheral edge and a top peripheral edge of the finished package having endless configurations and respectively dividing the bottom portion and the top portion from the main portion.

The bottom portion of the finished package normally includes a flat and horizontal bottom panel defining the resting surface of the package itself.

The top portion of the finished package may include a flat and horizontal top panel, parallel to the bottom panel; alternatively, gable top portions or slanted top portions are very conveniently used in combination with opening devices because sloping top panels are wider than corresponding flat top panels of parallelepiped or prismatic packages and therefore allow the application of larger opening devices, e.g. provided with screw caps or the like.

A new type of package has been recently devised, which is obtained by folding and sealing a basic unit of packaging material lacking the longitudinal crease lines in the intermediate region. This particular feature allows a high flexibility in the volume of the finished package, which takes a round configuration along the lateral edges.

An example of this package is shown in Chinese design application No. 201030154036.8.

Notwithstanding the mentioned important advantage of this particular type of package, some defects may arise at the corners between the lateral edges of the side walls and the bottom peripheral edge and top peripheral edge dividing the main portion of the package from the bottom portion and top portion thereof.

It is therefore an object of the present invention to provide a sheet packaging material, for producing a sealed package containing a pourable food product, which is designed to overcome the above-mentioned drawback in a straightforward and low-cost manner.

This object is achieved by a sheet packaging material as claimed in claim 1.

This object is also achieved by a sealed package as claimed in claim 8.

A preferred, non-limiting embodiment of the present invention will be described by way of example with reference to the accompanying drawings, in which.

Figure 1:
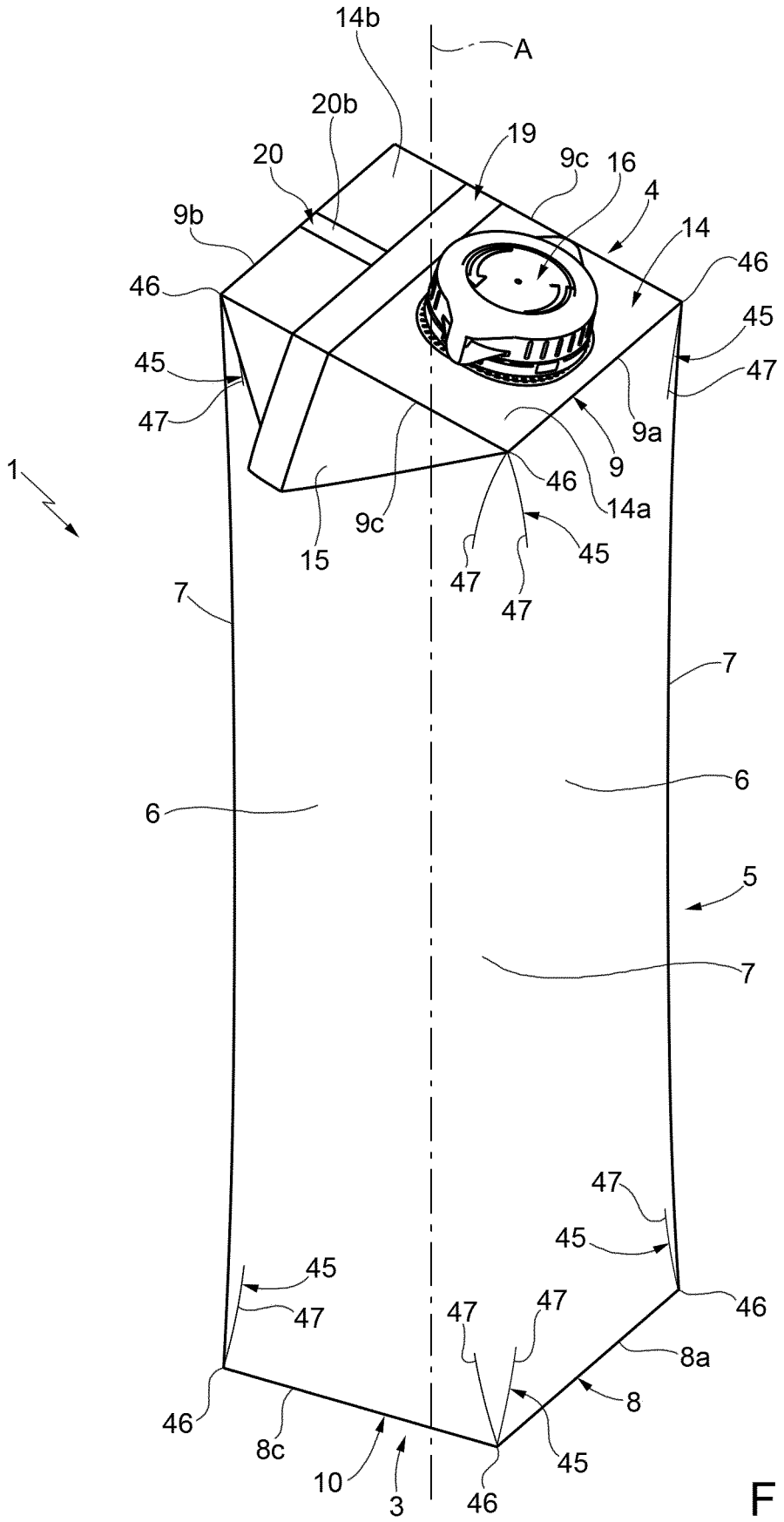
FIG. 1 is a perspective view of a sealed package containing a pourable food product and obtained from a sheet packaging material according to the present invention.
Figure 2:
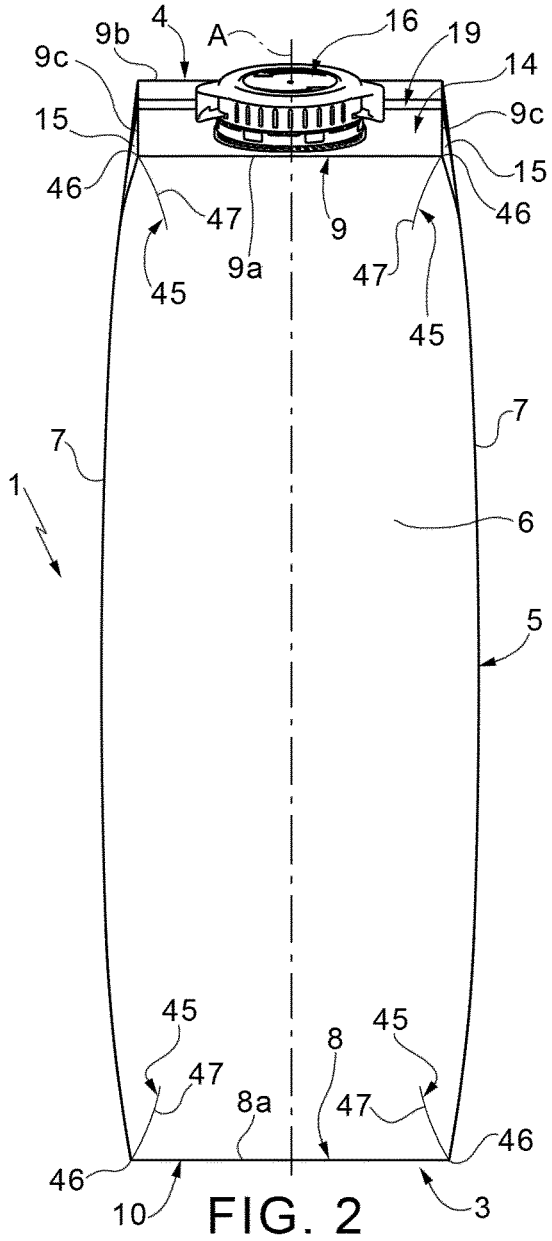
FIG. 2 is a smaller-scale front view of the package of FIG. 1.
Figure 3:
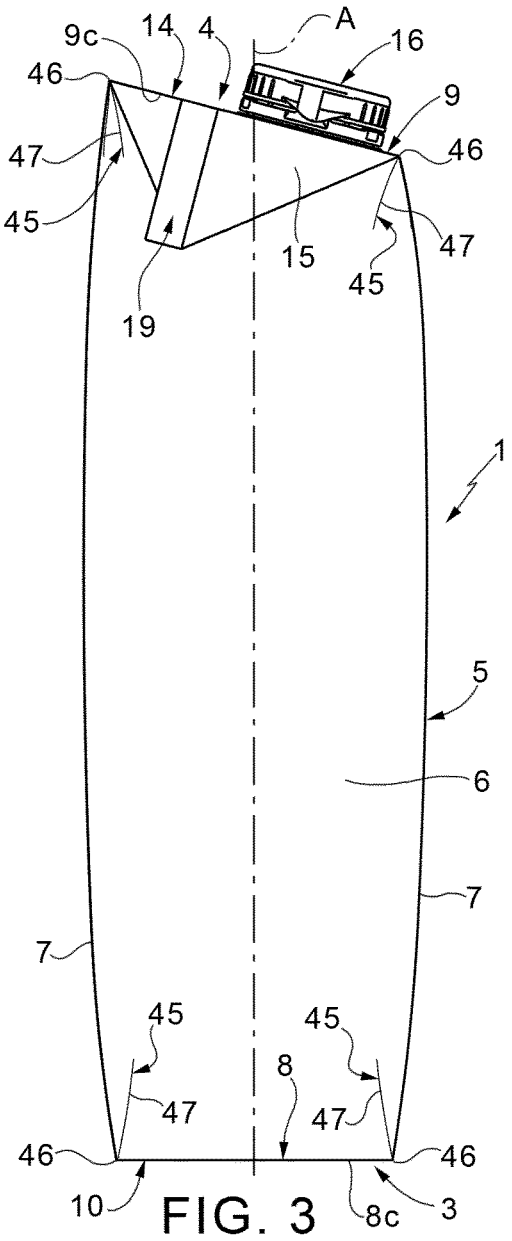
FIG. 3 is a smaller-scale side view of the package of FIG. 1.
Figure 4:
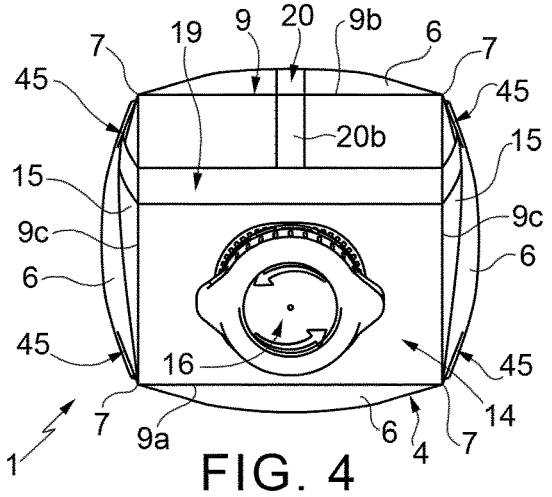
FIG. 4 is a smaller-scale top view of the package of FIG. 1.

Number 1 in FIGS. 1 to 5 indicates as a whole a sealed package containing a pourable food product and obtained from a sheet packaging material 2 (FIG. 6) according to the present invention.

Package 1 comprises a bottom portion 3, a top portion 4 and a main portion 5 interposed between bottom portion 3 and top portion 4 and including a plurality of side wall portions 6, each one delimited by two opposite lateral edge zones 7.

Main portion 5 is divided from bottom portion 3 by a bottom peripheral edge 8 having an endless configuration defined by a broken line. In a completely analogous manner, main portion 5 is divided from top portion 4 by a top peripheral edge 9, also having an endless configuration defined by a broken line.

Bottom portion 3 includes a flat and horizontal bottom panel 10 having a quadrilateral, i.e. rectangular or square (in the example shown rectangular), profile and defining the resting surface of the package itself.

Bottom panel 10 is delimited by bottom peripheral edge 8 in turn formed by four edge segments divided by respective vertices, i.e. a bottom front edge 8*a*, a bottom rear edge 8*b* parallel to bottom front edge 8*a* and two bottom side edges 8*c*, orthogonal to bottom front edge 8*a* and bottom rear edge 8*b*.

Package 1 extends vertically along a longitudinal direction A, which is orthogonal to bottom panel 10 and along which the total height of the package 1 itself is defined. Longitudinal direction A is also orthogonal to bottom front edge 8*a*, bottom rear edge 8*b* and bottom side edges 8*c* of bottom peripheral edge 8.

It is pointed out that, in the present description and in the claims, the term "total height" means either the height of the package when the latter has a constant height or the maximum height of the package when the latter has a variable height.

Figure 5:
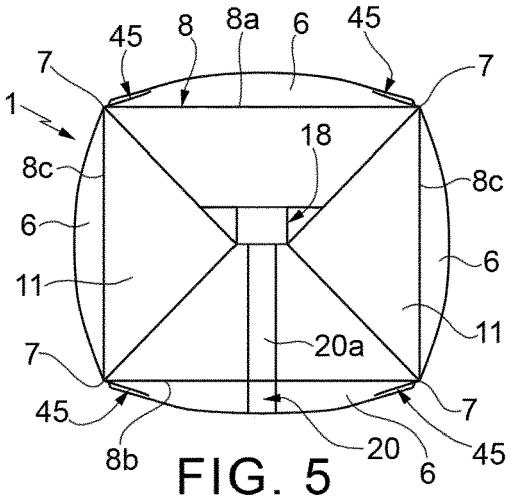
FIG. 5 is a smaller-scale bottom view of the package of FIG. 1.

Bottom portion 3 further includes two bottom lateral flaps 11 having substantially triangular configurations and folded in a known manner onto bottom panel 10 (FIG. 5).

Top portion 4 includes a flat and slanted top panel 14 having a quadrilateral, i.e. rectangular or square (in the example shown rectangular), profile and having a sloping configuration forwards with respect to longitudinal direction A.

Top panel 14 is delimited by top peripheral edge 9 in turn formed by four edge segments divided by respective vertices, i.e. a top front edge 9*a* parallel to bottom front edge 8*a* and bottom rear edge 8*b*, a top rear edge 9*b*, parallel to top front edge 9*a* and arranged higher than the top front edge 9*a* itself, and two top side edges 9*c*, orthogonal to top front edge 9*a* and top rear edge 9*b* and inclined with respect to longitudinal direction A.

As a consequence, top peripheral edge 9 extends transversally with respect to longitudinal direction A.

As a possible alternative not shown, package 1 may also have a different configuration in its top portion, which may be defined by a horizontal and flat top panel parallel to bottom panel 10 or by a gable top portion with two sloping top panels joined at their upper edges.

Top portion 4 further includes two top lateral flaps 15 having substantially triangular configurations and folded in a known manner onto two opposite side wall portions 6 of main portion 5.

As visible in FIGS. 1 to 4, top portion 4 is also provided with an opening device 16 of plastic material placed over and around a removable portion 17 (FIG. 5) of the packaging material 2. Opening device 16 is applied onto top panel 14 by conventional fastening systems, such as adhesives, or by micro-flame, electric-current-induction, ultrasound, laser, injection moulding or other heat-sealing techniques.

In the example shown in FIGS. 1 to 5, main portion 5 of package 1 includes four side wall portions 6 with different profiles and sizes; advantageously, lateral edge zones 7 delimiting side wall portions 6 have rounded configurations.

In particular, a first side wall portion 6, designed to define a front face portion of package 1, has a substantially rectangular configuration delimited, at bottom and top, by straight bottom front edge 8*a* and top front edge 9*a*, and at opposite sides, by respective rounded and convex lateral edge zones 7.

A second side wall portion 6, designed to define a rear face portion of package 1, also has a substantially rectangular configuration and is delimited, at bottom and top, by straight bottom rear edge 8*b* and top rear edge 9*b*, and at opposite sides, by respective rounded and convex lateral edge zones 7; this second side wall portion 6 faces the side wall portion 6 designed to define the front face portion of the package 1 and has a height, parallel to longitudinal direction A, greater than the height of this latter side wall portion 6.

Each of the other two side wall portions 6 has a profile substantially resembling a rectangular trapezium delimited:

at the bottom, by one respective horizontal bottom side edge 8*c;* at the top, by one respective inclined top side edge 9*c*; and at opposite sides, by respective rounded and convex lateral edge zones 7.

The two side wall portions 6 having the trapezoidal profiles receive the respective top lateral flaps 15 on their outer surfaces.

Figure 6:
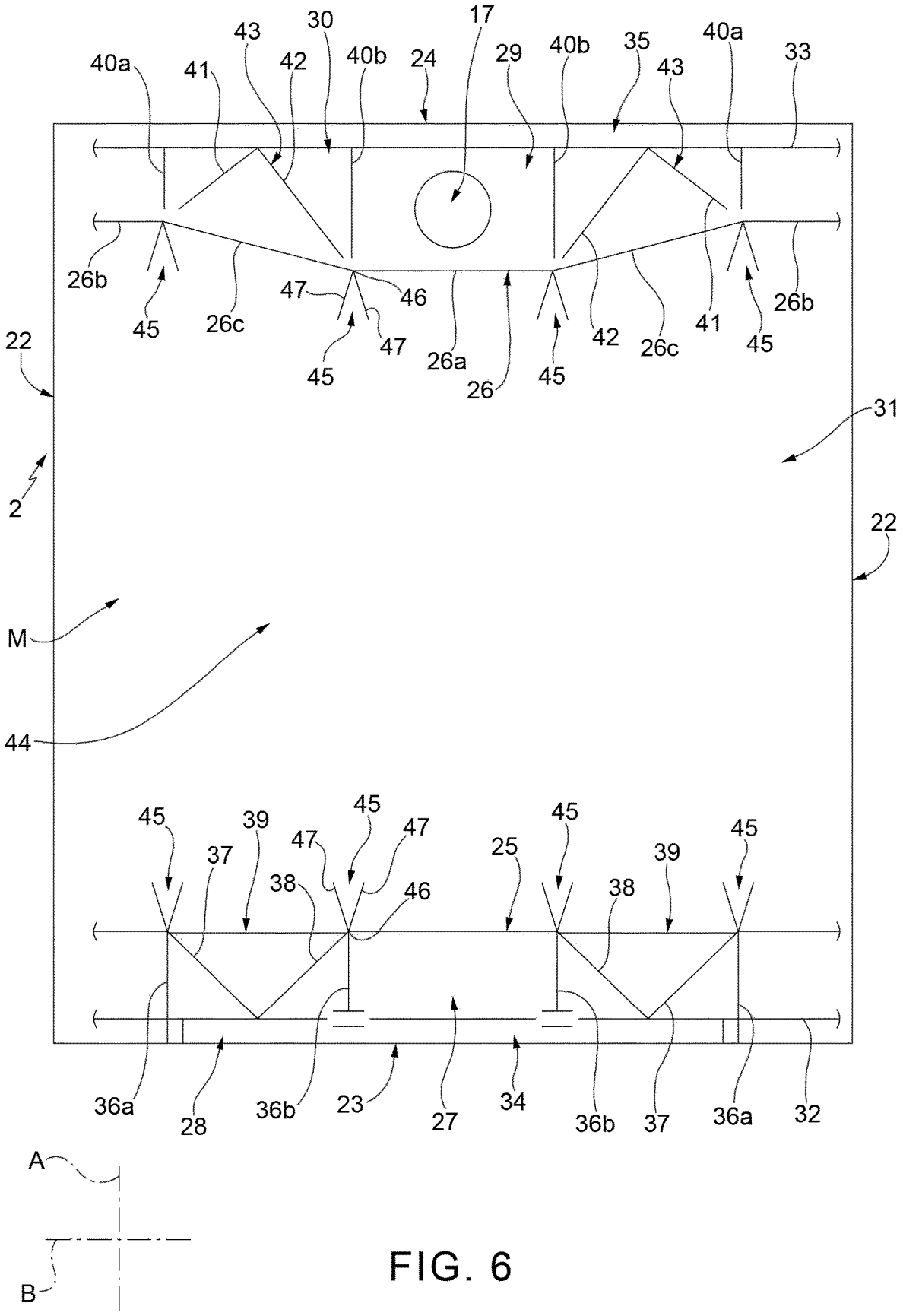
FIG. 6 is a front view of a basic unit of a sheet packaging material according to the present invention, from which the package of FIGS. 1 to 5 is obtained.

The packaging material 2 from which package 1 is made is shown in FIG. 6 and has a known multilayer structure (not shown) comprising a base layer, e.g. of paper, for stiffness, and a number of lamination layers covering both sides of the base layer.

Preferably, the lamination layers comprise one layer of oxygen-barrier material, e.g. an aluminum foil, and a number of layers of heat-seal plastic material covering both sides of the base layer and both sides of the layer of oxygen-barrier material. In other words, by proceeding from the side eventually forming the inside of package 1, packaging material 2 comprises one layer of heat-seal plastic material, one layer of oxygen-barrier material, another layer of heat-seal plastic material, the base layer, and one or more additional layers of heat-seal plastic material.

The letter M in FIG. 6 indicates a basic unit of packaging material 2, by which to produce package 1, and which may be a precut blank, or a portion of a web of packaging material comprising a succession of basic units M.

In the first case, basic unit M is folded on a known forming spindle (not shown), is filled with the food product, and is sealed at the top to form the final package.

In the second case, described therein with reference to FIGS. 1 to 8, the web of packaging material 2, comprising a succession of basic units M, is:

- folded into a cylinder and sealed longitudinally to form a vertical tube;
- filled continuously with the food product; and
- sealed transversely and cut into basic units M, which are then folded to form respective packages 1.

After completion of these operations, package 1 has:

- a bottom transverse sealing band 18 (FIG. 5) crossing bottom panel 10 along a centre line thereof and extending parallel to bottom front edge 8*a* and bottom rear edge 8*b;*
- a top transverse sealing band 19 (FIGS. 1 to 4) crossing top panel 14 parallel to, and between, top front edge 9*a* and top rear edge 9*b*; and
- longitudinal sealing band 20 extending a perpendicularly between the bottom transverse sealing band 18 and the top transverse sealing band 19 along respective portions of bottom panel 10 and top panel 14 and along the side wall portion 6 defining the rear face portion of package 1.

More specifically, after package 1 is completely sealed and formed, bottom panel 10 is crossed by bottom transverse sealing band 18 and by an end portion 20*a* of longitudinal sealing band 20 extending perpendicularly from the bottom transverse sealing band 18.

In a completely analogous way, after package 1 is completely sealed and formed, top panel 14 is crossed by top transverse sealing band 19 and by an end portion 20*b* of longitudinal sealing band 20 extending perpendicularly from the top transverse sealing band 19 and opposite to end portion 20*a*; in greater detail, top transverse sealing band 19 divides top panel 14 into two zones 14*a*, 14*b* and end portion 20*b* of longitudinal sealing band 20 extends on one (14*b*) of such zones 14*a*, 14*b* from an intermediate portion of the top transverse sealing band 19.

During the forming operations to obtain package 1, top transverse sealing band 19 is folded on zone 14*b* and end portion 20*b* of longitudinal sealing band 20; in this way, zone 14*a* has a bigger area than zone 14*b* and is therefore more suitable for receiving removable portion 17 and opening device 16.

In the example shown in FIG. 6, removable portion 17 has a circular profile and is designed to be at least partly detached in use from the rest of the packaging material by opening device 16 to free a pour opening through which to pour out the product.

Removable portion 17 is formed on packaging material 2 prior to folding and sealing the packaging material 2 itself to form the finished package.

In the present case, removable portion 17 comprises a so-called "prelaminated" hole, i.e. a circular hole formed through the base layer only of packaging material 2 and covered, when the packaging material 2 itself is laminated, with the layers of heat-seal plastic material and oxygen-barrier material, which adhere to one another at the hole.

With particular reference to FIG. 6, basic unit M of packaging material 2 has a rectangular configuration and is delimited by:

- two side boundary edges 22 parallel to a longitudinal direction coinciding with longitudinal direction A in an upright condition of basic unit M;
- a bottom boundary edge 23 parallel to a transversal direction B orthogonal to longitudinal direction A; and
- a top boundary edge 24 parallel to transversal direction B and to bottom boundary edge 23.

Basic unit M of packaging material 2 comprises a number of crease lines defining respective fold lines, along which the packaging material 2 itself is folded to form the finished package 1.

More specifically, basic unit M comprises two transversal crease lines 25, 26 extending transversally with respect to longitudinal direction A and dividing the basic unit M itself into:

- a bottom region 27 containing a bottom crease pattern 28 and configured to form bottom portion 3 of package 1;
- a top region 29 containing a top crease pattern 30 and configured to form top portion 4 of package 1; and
- an intermediate region 31 contained between transversal crease lines 25, 26, interposed between bottom region 27 and top region 29 and designed to form side wall portions 6 of package 1.

Transversal crease line 25 extends parallel to bottom boundary edge 23 and top boundary edge 24 and is arranged closer to bottom boundary edge 23 than transversal crease line 26. Transversal crease line 25 is configured to define bottom peripheral edge 8 of package 1.

Transversal crease line 26 is arranged closer to top boundary edge 24 than transversal crease line 25 and is configured to define top peripheral edge 9 of package 1. In particular, transversal crease line 26 has a broken-line shape with:

- a central portion 26*a* parallel to transversal direction B and configured to define top front edge 9*a* of package 1;
- two end portions 26*b* parallel to transversal direction B, arranged closer to top boundary edge 24 than central portion 26*a* and configured to define top rear edge 9*b* of package 1; and
- two inclined portions 26*c*, having slanted configurations with respect to longitudinal direction A and transversal direction B and each one connecting central portion 26*a* to respective end portions 26*b*.

Basic unit M includes two further transversal crease lines 32, 33 extending parallel to direction B and placed near bottom boundary edge 23 and top boundary edge 24, respectively; transversal crease lines 32, 33 delimit with bottom boundary edge 23 and top boundary edge 24 respective bottom transversal sealing area 34 and top transversal sealing area 35 configured to define bottom transversal sealing band 18 and top transversal sealing band 19 of package 1.

Bottom crease pattern 28 is designed to produce bottom panel 10 and bottom lateral flaps 11 of package 1. In particular, bottom crease pattern 28 includes, in a known manner, four longitudinal crease lines 36*a*, 36*b* parallel to longitudinal direction A and extending between transversal crease lines 25 and 32.

Longitudinal crease lines 36*b* are the most internal ones, whilst longitudinal crease lines 36*a* are located near opposite side boundary edges 22; the area between longitudinal crease lines 36*b* as well as the areas delimited by longitudinal crease lines 36*a* with the respective side boundary edges 22 are configured to define bottom panel 10 of package 1.

In each of the areas delimited between longitudinal crease lines 36*a* and 36*b*, bottom crease pattern 28 further includes two additional crease lines 37, 38 inclined with respect to both longitudinal direction A and transversal direction B.

In particular, the additional crease lines 37, 38 of each pair have one end in common located on transversal crease line 32 and opposite ends located at the intersection points between transversal crease line 25 and longitudinal crease lines 36*a* and 36*b*, respectively. In this way, each pair of additional crease lines 37, 38 delimits a triangle 39 with the segment of transversal crease line 25 comprised between the additional crease lines 37, 38 themselves.

Each area between longitudinal crease lines 36*a* and 36*b* is configured to define one respective bottom lateral flap 11 of package 1.

Top crease pattern 30 is designed to produce top panel 14 and top lateral flaps 15 of package 1. In particular, top crease pattern 30 includes four longitudinal crease lines 40*a*, 40*b* parallel to longitudinal direction A and extending between transversal crease lines 26 and 33.

Longitudinal crease lines 40*b* are the most internal ones, whilst longitudinal crease lines 40*a* are located near opposite side boundary edges 22; the area between longitudinal crease lines 40*b* as well as the areas delimited by longitudinal crease lines 40*a* with the respective side boundary edges 22 are configured to define top panel 14 of package 1. Removable portion 17 is formed in the area of top region 29 comprised between longitudinal crease lines 40*b*.

In each of the areas delimited between longitudinal crease lines 40*a* and 40*b*, top crease pattern 30 further includes two additional crease lines 41, 42 inclined with respect to both longitudinal direction A and transversal direction B.

In particular, the additional crease lines 41, 42 of each pair have one end in common located on transversal crease line 33 and opposite ends located at, or adjacent to, the opposite ends of the respective inclined portion 26*c* of transversal crease line 26.

In this way, each pair of additional crease lines 41, 42 delimits a triangle 43 with the respective inclined portion 26*c* of transversal creased line 26.

Each area between longitudinal crease lines 40*a* and 40*b* is configured to define one respective top lateral flap 15 of package 1.

According to an important aspect of the present invention, intermediate region 31 of basic unit M further comprises a plurality of V-shaped crease lines 45 having respective vertices 46 located on or adjacent to the transversal crease lines 25, 26 and at given points thereof designed to define the opposite ends of respective lateral edge zones 7 delimiting the side wall portions 6 of package 1; each V-shaped crease line 45 extends from and in proximity of the respective transversal crease line 25, 26 and comprises two legs 47 diverging from the respective vertex 46. In practice, V-shaped crease lines 45 extend from and in proximity of the respective vertices of bottom portion 3 and top portion 4.

In particular, each V-shaped crease line 45 extends from the respective transversal crease line 25, 26 towards the other transversal crease line 26, 25 and has a size, parallel to longitudinal direction A, greater than zero and smaller than one fourth, preferably smaller than one tenth, of the total height of intermediate region 31 measured parallel to the longitudinal direction A itself.

It is pointed out that, in the present description and in the claims, the term "total height of intermediate region 31" corresponds to the total height of the package.

In practice, each V-shaped crease line 45 extending from transversal crease line 25 and the corresponding V-shaped crease line 45 extending from transversal crease line 26 are spaced apart parallel to longitudinal direction A.

Preferably, each V-shaped crease line 45 has a size, parallel to longitudinal direction A, smaller than the maximum height of bottom region 27 or top region 29 measured parallel to the longitudinal direction A itself.

More preferably, each leg of the V-shaped crease lines 45 has a length smaller than the maximum length of the heights of triangles 39, 43 with reference to their bases on respective transversal crease lines 25, 26.

In the example shown, each V-shaped crease line 45 has a size, parallel to longitudinal direction A, substantially equal to one fourteenth of the total height of intermediate region 31 measured parallel to the longitudinal direction A itself.

As visible in FIGS. 1 to 5, V-shaped crease lines 45 are the only crease lines present in intermediate region 31 at the areas designed to define lateral edge zones 7 between side wall portions 6 of package 1.

In practice, intermediate region 31 includes a central transversal band 44 having a uniform structure, i.e. lacking any creasing or weakening, and crossing the areas of the intermediate region 31 itself designed to form the respective lateral edge zones 7 of side wall portions 6 of package 1.

In the example shown, legs 47 of each V-shaped crease line 45 are rectilinear or straight; as a possible alternative not shown, legs 47 of each V-shaped crease line 45 may also be curved, preferably with their concavities facing one another.

Preferably, legs 47 of each V-shaped crease line 45 delimit an angle comprised between 45° and 90°.

Figure 7:
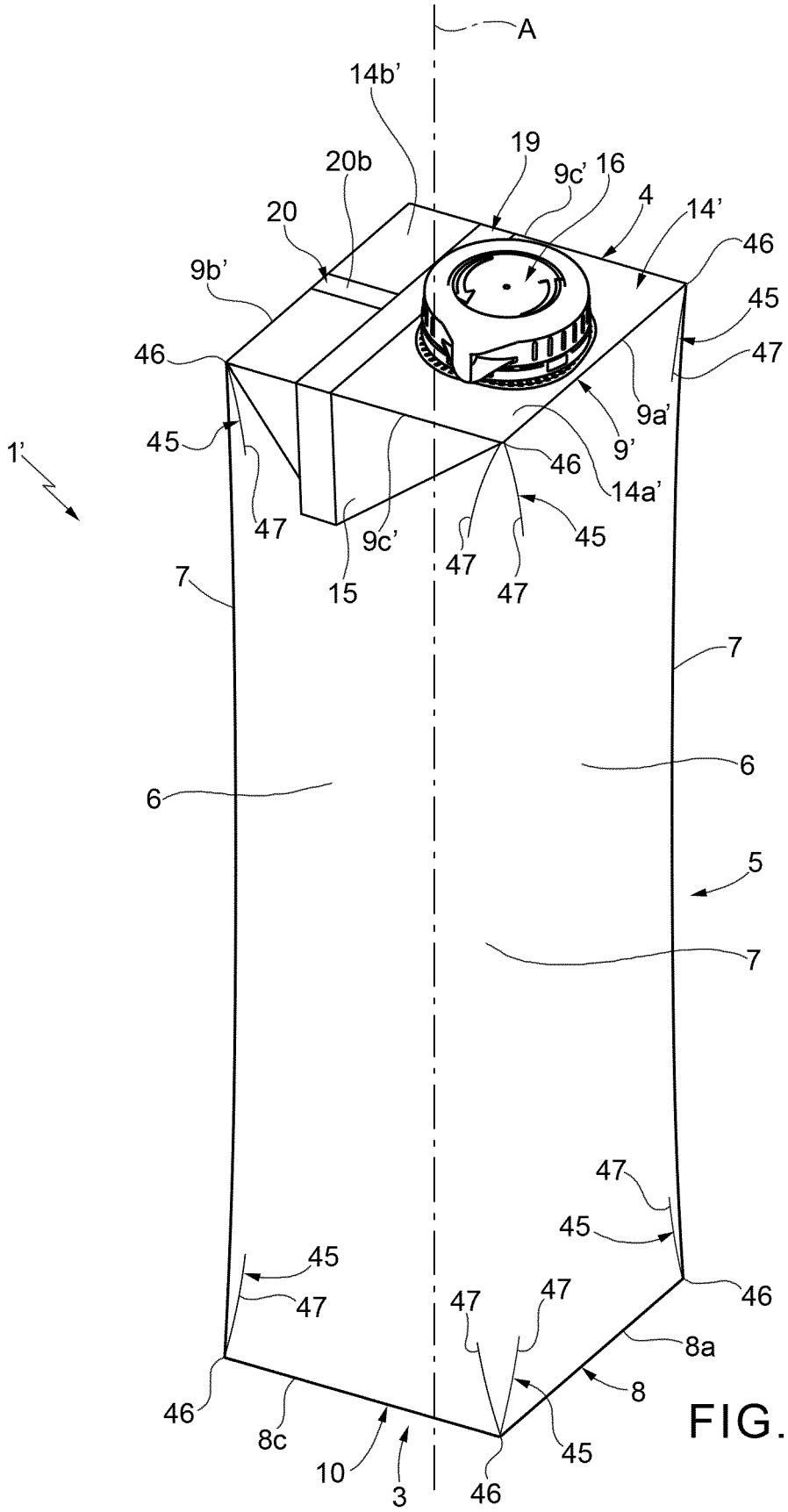
FIG. 7 is a perspective view of a sealed package according to another embodiment the present invention.
Figure 8:
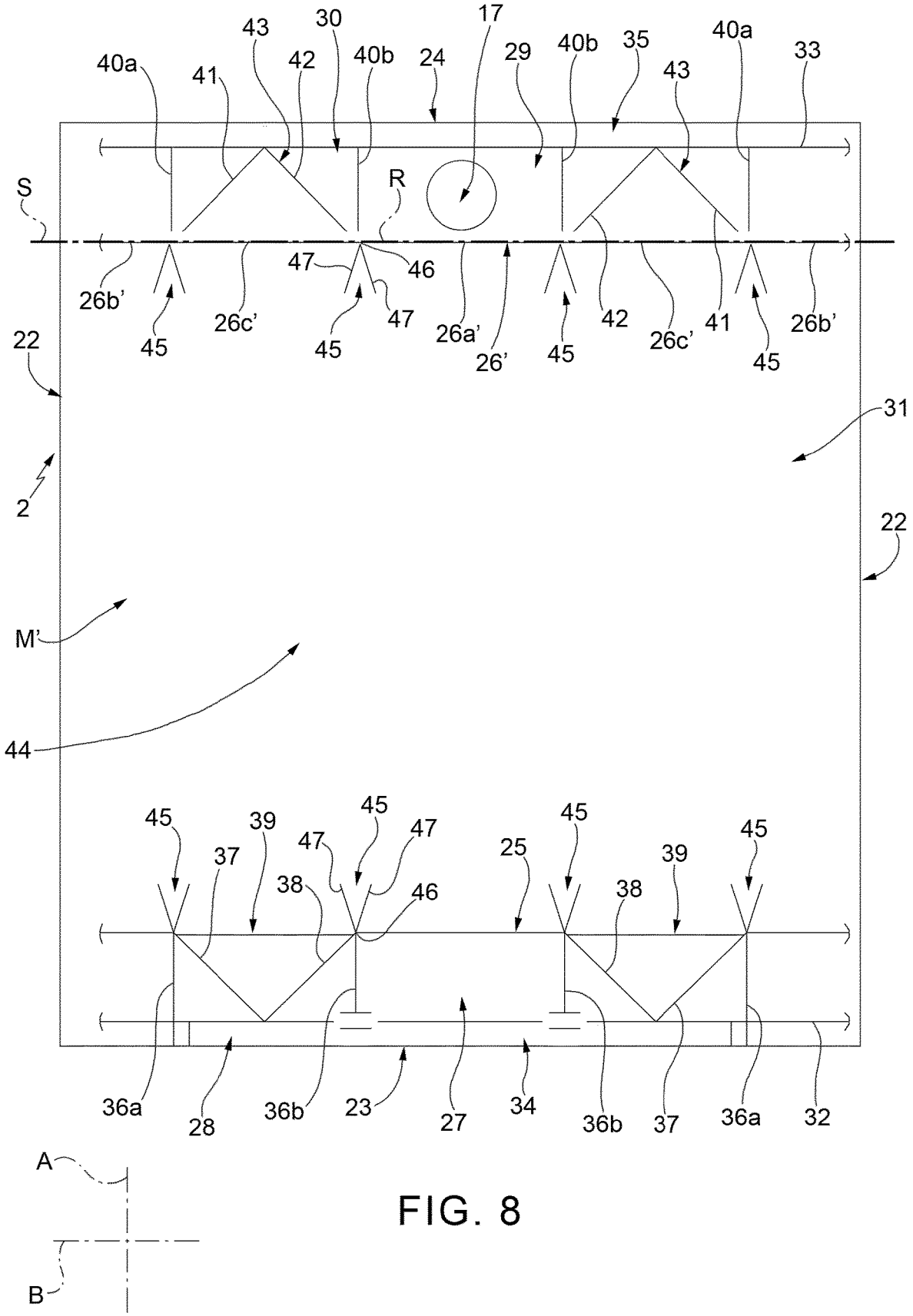
FIG. 8 is a front view of a basic unit of a sheet packaging material according to the present invention, from which the package of FIG. 7 is obtained.

Number 1' in FIG. 7 indicates as a whole a different embodiment of a sealed package according to the present invention and obtained by a basic unit M' (FIG. 8) of sheet packaging material 2. Package 1' being similar to package 1, the following description is limited to the differences between them, and using the same references, where possible, for identical or corresponding parts; the same applies for basic units M' and M.

In particular, package 1' differs from package 1 only by having a top panel 14' that extends horizontally and parallel to bottom panel 10.

In greater details, top panel 14' is delimited by a top peripheral outline 9' (formed by edges 9*a*', 9*b*', 9*c*') parallel to bottom peripheral outline 8 and deriving by a transversal crease line 26' also parallel to transversal crease line 25 and to transversal direction B.

The advantages of packaging material 2 and packages 1, 1' according to the present invention will be clear from the above description. In particular, thanks to the presence of the V-shaped crease lines 45, the packages 1, 1' obtained from basic units M, M' of packaging material 2 present high flexibility of filling volume as well as high quality of forming at the corners between lateral edge zones 7 of side wall portions 6 and respective bottom peripheral edges 8 and top peripheral edges 9, 9'.

As a matter of fact, each package 1, 1' presents a round configuration along lateral edge zones 7 due to the absence of continuous longitudinal crease lines between bottom peripheral edge 8 and top peripheral edge 9, 9' or between transversal crease lines 25, 26, 26'. At the same time, V-shaped crease lines 45 ease folding of the packaging material 2 at the corners between lateral edge zones 7 of side wall portions 6 and bottom peripheral edge 8 and top peripheral edge 9, 9' without affecting the round configuration of lateral edge zones 7.

Clearly, changes may be made to packaging material 2 and packages 1, 1' as described and illustrated herein without, however, departing from the scope defined in the accompanying claims.

In particular, V-shaped crease lines 45 may also extend from only one of transversal crease lines 25, 26, 26' or, in a completely equivalent manner, from only one of bottom and top peripheral edges 8, 9, 9'.

In practice, V-shaped crease lines 45 may also extend from and in proximity of the respective vertices of only one of bottom portion 3 and top portion 4.

The invention claimed is:

1. A sheet packaging material for producing a sealed package containing a pourable food product, said packaging material having a rectangular or square configuration with two boundary edges parallel to a longitudinal direction and two other boundary edges parallel to a transversal direction orthogonal to said longitudinal direction; said packaging material comprising at least two transversal crease lines extending transversally to said longitudinal direction and dividing the packaging material into:

a bottom region containing a bottom crease pattern and configured to form a bottom portion of said package;

a top region containing a top crease pattern and configured to form a top portion of said package; and an intermediate region contained between said transversal crease lines, interposed between said bottom region and said top region and designed to form a main portion of said package having a plurality of side wall portions;

wherein said transversal crease lines are configured to define a bottom peripheral edge and a top peripheral edge of said package respectively dividing said bottom portion and said top portion from said main portion;

wherein said intermediate region further comprises a plurality of V-shaped crease lines having respective vertices located on or adjacent to at least a first transversal crease line of the transversal crease lines and at given points thereof destined to define the ends of respective lateral edge zones delimiting the side wall portions of said package; each said V-shaped crease line extending from and in proximity of said first transversal crease line towards a second transversal crease line of said transversal crease lines; each said V-shaped crease line comprising two legs diverging from the respective vertex; said V-shaped crease lines being the only crease lines present in said intermediate region at the areas designed to define the lateral edge zones between the side wall portions of said package, and wherein each V-shaped crease line has a size, parallel to said longitudinal direction, smaller than a maximum height of the bottom region or the top region measured parallel to the longitudinal direction.

2. The packaging material as claimed in claim 1, wherein said V-shaped crease lines also extend from said second transversal crease line, face the corresponding V-shaped crease lines extending from the first transversal crease line and have respective legs diverging towards said first transversal crease line.

3. The packaging material as claimed in claim 1, wherein each V-shaped crease line extending from the first transversal crease line and the corresponding V-shaped crease line extending from the second transversal crease line are spaced apart parallel to said longitudinal direction.

4. The packaging material as claimed in claim 1, wherein the legs of each V-shaped crease line are rectilinear or curved.

5. The packaging material as claimed in claim 1, wherein the legs of each V-shaped crease line delimit an angle comprised between 45° and 90°.

6. A sheet packaging material for producing a sealed package containing a pourable food product, said packaging material having a rectangular or square configuration with two boundary edges parallel to a longitudinal direction and two other boundary edges parallel to a transversal direction orthogonal to said longitudinal direction; said packaging material comprising at least two transversal crease lines extending transversally to said longitudinal direction and dividing the packaging material into:

a bottom region containing a bottom crease pattern and configured to form a bottom portion of said package;

a top region containing a top crease pattern and configured to form a top portion of said package; and an intermediate region contained between said transversal crease lines, interposed between said bottom region and said top region and designed to form a main portion of said package having a plurality of side wall portions;

wherein said transversal crease lines are configured to define a bottom peripheral edge and a top peripheral edge of said package respectively dividing said bottom portion and said top portion from said main portion;

wherein said intermediate region further comprises a plurality of V-shaped crease lines having respective vertices located on or adjacent to at least a first transversal crease line of the transversal crease lines and at given points thereof destined to define the ends of respective lateral edge zones delimiting the side wall portions of said package; each said V-shaped crease line extending from and in proximity of said first transversal crease line towards a second transversal crease line of said transversal crease lines; each said V-shaped crease line comprising two legs diverging from the respective vertex; said V-shaped crease lines being the only crease lines present in said intermediate region at the areas designed to define the lateral edge zones between the side wall portions of said package, wherein each said V-shaped crease line extends from said first transversal crease line towards said second transversal crease line and has a size, parallel to said longitudinal direction, greater than zero and smaller than one fourth of the total height of said intermediate region measured parallel to the longitudinal direction.

7. A sealed package containing a pourable food product and obtained from a sheet packaging material, said package comprising a bottom portion, a top portion and a main portion interposed between said bottom portion and said top portion and including a plurality of side wall portions;

wherein said main portion is divided from said bottom portion and said top portion by respective peripheral edges;

wherein said peripheral edges extend transversally with respect to a longitudinal direction, along which the total height of the package is defined;

wherein said main portion further comprises a plurality of V-shaped crease lines having respective vertices located on or adjacent to at least a first peripheral edge of said peripheral edges and at given points thereof defining the ends of respective lateral edge zones delimiting the side wall portions; each said V-shaped crease line extending from and in proximity of said first peripheral edge towards a second peripheral edge of said peripheral edges; each said V-shaped crease line comprising two legs diverging from the respective vertex; said V-shaped crease lines being the only crease lines present in said main portion at the areas defining said lateral edge zones between said side wall portions, wherein each V-shaped crease line has a size, parallel to said longitudinal direction, smaller than a maximum height of the bottom region or the top region measured parallel to the longitudinal direction.

8. The package as claimed in claim 7, wherein each said V-shaped crease line extends from said first peripheral edge towards said second peripheral edge and has a size, parallel to said longitudinal direction, greater than zero and smaller than one fourth of the total height of said package.

9. The package as claimed in claim 7, wherein said V-shaped crease lines also extend from said second peripheral edge, face the corresponding V-shaped crease lines extending from the first peripheral edge and have respective legs diverging towards said first peripheral edge.

10. The package as claimed in claim 7, wherein each V-shaped crease line extending from the first peripheral edge and the corresponding V-shaped crease line extending from the second peripheral edge are spaced apart parallel to said longitudinal direction.

11. The package as claimed in claim 7, wherein the legs of each V-shaped crease line are rectilinear or curved.

12. The package as claimed in claim 7, wherein the legs of each V-shaped crease line delimit an angle comprised between 45° and 90°.

13. The package as claimed in claim 7, wherein said V-shaped crease lines extend from and in proximity of respective vertices of the bottom portion and/or the top portion.

14. The package as claimed in claim 7, wherein said top portion further includes two top lateral flaps folded onto two opposite side wall portions of said main portion.

* * * * *